US011655432B2

(12) United States Patent
Sun

(10) Patent No.: US 11,655,432 B2
(45) Date of Patent: May 23, 2023

(54) LIQUID DETERGENT COMPOSITIONS THAT INCLUDE A MIXTURE OF ECOLOGICALLY-RESPONSIBLE SURFACTANTS

(71) Applicant: Henkel AG & Co. KGaA, Duesseldorf (DE)

(72) Inventor: Wei Sun, Trumbull, CT (US)

(73) Assignee: Henkel AG & Co. KGaA, Duesseldorf (DE)

( * ) Notice: Subject to any disclaimer, the term of this patent is extended or adjusted under 35 U.S.C. 154(b) by 479 days.

(21) Appl. No.: 16/547,741

(22) Filed: Aug. 22, 2019

(65) Prior Publication Data

US 2021/0054305 A1 Feb. 25, 2021

(51) Int. Cl.

| | |
|---|---|
| ***C11D 1/00*** | (2006.01) |
| ***C11D 1/29*** | (2006.01) |
| ***C11D 1/72*** | (2006.01) |
| ***C11D 11/00*** | (2006.01) |
| ***C11D 17/04*** | (2006.01) |
| ***C11D 1/83*** | (2006.01) |

(52) U.S. Cl.

CPC ..... *C11D 1/29* (2013.01); *C11D 1/72* (2013.01); *C11D 1/83* (2013.01); *C11D 11/0017* (2013.01); *C11D 17/043* (2013.01)

(58) Field of Classification Search

CPC ..... C11D 1/29; C11D 1/72; C11D 1/83

See application file for complete search history.

(56) References Cited

U.S. PATENT DOCUMENTS

| | | | | |
|---|---|---|---|---|
| 7,648,953 | B2 | 1/2010 | Bastigkeit et al. | |
| 7,709,436 | B2 | 5/2010 | Theiler et al. | |
| 8,022,028 | B2 | 9/2011 | Szewczyk et al. | |
| 9,796,948 | B2 | 10/2017 | Shearouse et al. | |
| 9,926,514 | B1 | 3/2018 | Wycoff | |
| 10,519,400 | B2 * | 12/2019 | Delaney | C11D 3/30 |
| 2014/0349913 | A1 * | 11/2014 | Delaney | C11D 3/3723 510/488 |
| 2014/0349914 | A1 * | 11/2014 | Holder | C11D 3/2086 510/488 |
| 2019/0177655 | A1 * | 6/2019 | Garbark | C07C 237/06 |

FOREIGN PATENT DOCUMENTS

| | | | |
|---|---|---|---|
| WO | 2012149617 | A1 | 11/2012 |
| WO | 2016-160407 | A1 | 10/2016 |

OTHER PUBLICATIONS

ASTM Designation D4265-14, "Standard Guide for Evaluating Stain Removal Performance in Home Laundering," ASTM International, Jan. 2014, pp. 418-425.

ASTM Designation D6866-16, "Standard Test Methods for Determining the Biobased Content of Solid, Liquid, and Gaseous Samples Using Radiocarbon Analysis," ASTM International, Jan. 2016, pp. 1-19.

International Searching Authority, PCT International Search Report, PCT/US2020/047641, Dec. 2, 2020, pp. 1-10, International Application Division, Korean Intellectual Property Office, Daejeon, Republic of Korea.

* cited by examiner

*Primary Examiner* — Necholus Ogden, Jr.
(74) *Attorney, Agent, or Firm* — Bojuan Deng

(57) ABSTRACT

A detergent composition includes an anionic detergent surfactant blend including alkyl ethoxylate sulfate (AES) and sodium lauryl sulfate (SLS). A weight ratio of AES to SLS is from about 5:1 to about 1:5. The detergent composition further includes a nonionic detergent surfactant. A weight ratio of the anionic detergent surfactant blend to nonionic detergent surfactant is from about 3:1 to about 1:3. Still further, the detergent composition includes water. A bio-based carbon content of the detergent composition based on ASTM D6866 is from about 50% to about 100% by weight of the overall detergent composition.

11 Claims, No Drawings

LIQUID DETERGENT COMPOSITIONS THAT INCLUDE A MIXTURE OF ECOLOGICALLY-RESPONSIBLE SURFACTANTS

FIELD OF THE INVENTION

The technical field relates to various consumer, commercial, and industrial detergent compositions, which include biodegradable and ecologically-responsible ingredients, specifically surfactants, and which exhibit good performance compared to traditional detergent formulations. In particular, for example, this disclosure relates to ecologically-responsible liquid detergent compositions that utilize unique surfactant combinations that exhibit both good detersive performance and relatively high viscosity.

BACKGROUND OF THE INVENTION

It is well known that many consumer, commercial, and industrial products include liquid detergents. For example, in the context of laundry detergents, many detergents include blends of synthetic anionic, nonionic, and conditioning cationic surfactants, along with any number of additional ingredients such as builders, dispersants, soil-release polymers, detersive enzymes and bleaching agents to improve cleaning performance and to arrive at consumer-acceptable performance at a reasonable cost. The term "synthetic" is used herein to refer to surfactants that are not "bio-based." The term "bio-based" is used herein to refer to materials that are derived in whole or in part from biomass resources. Biomass resources are organic materials that are available on a renewable or recurring basis such as crop residues, wood residues, grasses, and aquatic plants. Corn ethanol is a well-known example of a bio-based material derived from biomass resources. The amount of bio-based content of a surfactant is determined in accordance with ASTM D6866: "Standard Test Methods for Determining the Bio-Based Content of Solid, Liquid, and Gaseous Samples Using Radiocarbon Analysis," the contents of which are incorporated by reference herein in their entirety.

Prior art attempts to replace one or more of these synthetic surfactants with more eco-friendly alternatives, such as bio-based surfactants, have resulted in detergent compositions with either or both of poor detersive performance and undesirably low viscosity. Undesirably low viscosity, for example, lower than 200 cps at ambient temperature, can be perceived as a low-active product, which could denote poor cleaning to consumers. Additionally, such low viscosities can result into processing challenges during manufacture, for example the effect of "splashing" when filling the liquid detergent into its product containers. Heretofore there have been no suitable "across-the-board" substitutions of synthetic ingredients to more ecologically friendly ingredients in a laundry detergent composition that can still provide consumer-acceptable performance at reasonable cost to the manufacturer.

Accordingly, in view of the foregoing, it is desirable to provide a liquid detergent composition that includes a significant proportion of bio-based carbon in its ingredients (for example, greater than about 50% based on the ASTM D6866 method), but that does not exhibit a reduced cleaning efficiency or a reduced viscosity. Furthermore, other desirable features and characteristics will become apparent from the subsequent detailed description and the appended claims, taken in conjunction with the accompanying drawings and the foregoing technical field and background.

BRIEF SUMMARY OF THE INVENTION

It has been discovered by the inventors herein that it is possible to remove anionic surfactants from detergent compositions that have high synthetic carbon content, such as synthetic linear alkylbenzene sulfonate (LAS) and synthetic alkyl ethoxylate sulfate (AES), and replace them with particular surfactants that have high bio-based carbon content, while overcoming prior art challenges of poor cleaning capability and unacceptably-low viscosity. In particular, it has been discovered that using an anionic surfactant blend of bio-based AES in combination with sodium lauryl sulfate (SLS) in particular weight-percent ratios, namely from about 5:1 to about 1:5, the aforementioned problems of poor cleaning capability and unacceptably-low viscosity can be overcome.

Accordingly, in one embodiment, disclosed herein is a detergent composition that includes an anionic detergent surfactant blend including alkyl ethoxylate sulfate (AES) and sodium lauryl sulfate (SLS). A weight ratio of AES to SLS is from about 5:1 to about 1:5. The detergent composition further includes a nonionic detergent surfactant. A weight ratio of the anionic detergent surfactant blend to nonionic detergent surfactant is from about 3:1 to about 1:3. Still further, the detergent composition includes water. A bio-based carbon content of the detergent composition based on ASTM D6866 is from about 50% to about 100%.

Disclosed in another embodiment is a detergent composition that includes, by weight percent of the overall composition, an anionic detergent surfactant blend in an amount of about 0.1% to about 30% including alkyl ethoxylate sulfate (AES) and sodium lauryl sulfate (SLS). A weight ratio of AES to SLS is from about 4:1 to about 1:4. The detergent composition further includes a nonionic detergent surfactant in an amount of about 1% to about 30%. A weight ratio of the anionic detergent surfactant to the nonionic detergent surfactant is from about 2:1 to about 1:2. Still further, the detergent composition includes water. A bio-based carbon content of the detergent composition based on ASTM D6866 is from about 60% to about 100%. The detergent surfactant substantially excludes linear alkylbenzene sulfonate (LAS).

This brief summary is provided to describe select concepts in a simplified form that are further described in the detailed description. This brief summary is not intended to identify key or essential features of the claimed subject matter, nor is it intended to be used as an aid in determining the scope of the claimed subject matter.

DETAILED DESCRIPTION OF THE INVENTION

As used herein, the articles "a," "an," and "the" can be used herein to refer to one or to more than one (i.e., to at least one) of the grammatical object of the article, unless the language and/or context clearly indicates otherwise. By way of example, "an element" means one element or more than one element. Furthermore, as used herein, the term "about" as used in connection with a numerical value throughout the specification and the claims denotes an interval of accuracy, familiar and acceptable to a person skilled in the art. In general, such interval of accuracy is ±10%. Thus, "about ten" means 9 to 11. All numbers in this description indicating amounts, ratios of materials, physical properties of materials, and/or use are to be understood as modified by the word "about," except as otherwise explicitly indicated. As an additional matter, all percentage amounts of the components of the laundry detergent composition are by weight percent of the overall composition, unless otherwise specified.

The bio-based carbon content referenced in the present disclosure is determined in accordance with ASTM D6866, which distinguishes carbon resulting from contemporary biomass-based inputs from those derived from fossil-based inputs. Thus, ASTM D6866 is a measure of the amount of biomass-derived carbon in a product as compared to its total organic carbon content. ASTM D6866 described two alternative methods to determine the bio-based carbon content of a product. The first method uses accelerator mass spectrometry (AMS) along with isotope ratio mass spectrometry (IRMS) techniques to quantify the bio-based content of a given product. The second method uses liquid scintillation counter (LSC) techniques to quantify the bio-based content of a product using sample carbon that has been converted to benzene. Both described methods directly discriminate between product carbon resulting from contemporary carbon input and that derived from fossil-based input. A measurement of a product's $^{14}C/^{12}C$ or $^{14}C/^{13}C$ content is determined relative to a carbon based modern reference material accepted by the radiocarbon dating community.

The present disclosure generally relates to detergent compositions that include surfactants that are derived from bio-based carbon sources. The bio-based carbon content of the surfactants in the detergent compositions may be, by weight, from about 30% to about 100%, or from about 40% to about 100%, or from about 60% to about 100%, or from about 80% to about 100%, or from about 90% to about 100%. Reference to a certain percentage of bio-based carbon content is provided herein due to the fact that carbons in a given surfactant may have both a bio-based portion and a non-bio-based portion. One such example is $C_{24-7}$ alcohol ethoxylate, where the R (i.e., $C_{24}$) is bio-based and the carbons from the 7 ethoxylates are non-bio-based (as they are derived from ethylene that is cracked-down from petroleum products; therefore, $C_{24-7}$ is about 50% bio-based. Furthermore, as used herein, the term "detergent" is defined as any substance or preparation containing soaps and/or other surfactants intended for washing and cleaning processes. Thus, detergents are cleansing agents that can emulsify oils and hold dirt in suspension. More particularly, in one exemplary embodiment, "laundry detergent" refers to any type of detergent (cleaning agent) that is added for cleaning laundry, which can be in the form of a liquid or encapsulated into a unit dose pack, as described in greater detail below.

Detergent—Liquid or Unit Dose

The liquid detergents, in an embodiment, include anywhere from about 50% water to about 95% by weight water as solvent, such as from about 70% water to about 90% water, or from about 80% water to about 90% water. In further embodiment, the liquid detergents include from about 50% to about 60% by weight water, from about 60% to about 70% water, from about 70% to about 80% water, or from about 80% to about 95% water.

The detergent may alternatively be formulated into a unit dose pack. A unit dose pack is formed by encapsulating a detergent composition within a container, where the container is composed of a film, such as a polyvinyl alcohol-containing film. In some embodiments, the film forms one half or more of the container, where the container may also include dyes, print, or other components in some embodiments. The film is water soluble such that the film will completely dissolve when an exterior of the film is exposed to water, such as in a washing machine typically used for laundry. When the film dissolves, the container is ruptured and the contents are released. The detergent contained within the unit dose pack includes anywhere from about 5% water to about 45% by weight water as solvent, such as from about 10% water to about 40% water, or from about 15% water to about 35% water. In further embodiment, the liquid detergents include from about 5% to about 15% by weight water, from about 15% to about 25% water, from about 25% to about 35% water, or from about 35% to about 45% water.

Additional solvents may be included in either embodiment, wherein the additional solvents are present in an amount from about 0.1% to about 50% by weight of the detergent. Liquid detergent embodiments include these additional solvents at the lower end of this range, such as from about 0.1% to about 30%, or about 1% to about 25%, or about 5% to about 20%, by weight of the detergent. Conversely, unit dose pack detergent embodiments include these additional solvents at the higher end of this range, such as from about 15% to about 50%, or about 20% to about 45%, or about 25% to about 40%. Additional solvents may include polyethylene glycol, other polyols, ionic liquids, glycol ethers, EO/PO block copolymers, alcohols such as ethanol, and mixtures thereof.

Bio-Based Anionic Surfactant Blend

As initially noted above, the liquid detergent compositions of the present disclosure contain anionic surfactants that are derived, at least in part, from bio-based carbon sources. In particular, the detergent compositions utilize an anionic surfactant blend of bio-based alkyl ethoxylate sulfate (AES) in combination with sodium lauryl sulfate (SLS). AES is a polyethoxylated alcohol sulfate, also known as alkyl polyethoxylate sulfates, are those which correspond to the following formula (I):

$$R'—O—(C_2H_4O)n\text{-}SO_3M' \quad (I)$$

wherein R' is a $C_8$-$C_{20}$ alkyl group, n is from 1 to 20, and M' is a salt-forming cation, preferably, R' is $C_{10}$-$C_{18}$ alkyl, n is from 1 to 15, and M' is sodium, potassium, ammonium, alkylammonium, or alkanolammonium. In another embodiment, R' is a $C_{12}$-$C_{16}$ alkyl, n is from 1 to 6 and M' is sodium. AES is derivable from bio-based carbon sources, such as various plant oil sources. SLS is SLS is in the family of organosulfate compounds, and has the formula, $CH_3(CH_2)_{11}SO_4$ Na. It consists of a 12-carbon tail attached to a sulfate group, that is, it is the sodium salt of a 12-carbon alcohol that has been esterified to sulfuric acid. It is derived from lauryl alcohol, which can originate from various plant oil sources, such as coconut or palm kernel oil.

In total, the anionic detergent surfactants may be present in the detergent composition at a concentration of from about 0.1% to about 30% by weight in one embodiment, but the anionic detergent surfactants may be present in the detergent composition at a concentration of about 0.5% to about 20% or from about 1% to about 15% in alternate embodiments, or from about 2% to about 10%, where weight percentages are based on a total weight of the detergent composition. The anionic detergent surfactants may alternatively be present in an amount of about 0.1% to about 20% by weight, from about 0.1% to about 15%, or from about 0.5% to about 15%. With respect to one another, the by-weight ratio of AES to SLS is from about 5:1 to about 1:5, or from about 5:1 to about 1:3, or from about 5:1 to about 1:1, or from about 5:1 to about 3:1. In other embodiments, the by-weight ratio of AES to SLS is from about 4:1 to about 1:4, or from about 3:1 to about 1:3, or from about 2:1 to about 1:2. AES and SLS, in the combination described above, provide a synergistic benefic in terms of cleaning capability and viscosity that has eluded prior art detergent compositions that attempted to transition to bio-based carbon detergent sources.

Moreover, in some embodiments, the detergent composition may substantially exclude linear alkylbenzene sulfonate (LAS). "Substantially exclude" means that the detergent composition contains no more than about 1% by weight of the stated ingredient, for example from 0% to about 1%, from 0% to about 0.8%, from 0% to about 0.6%, from 0% to about 0.4%, from 0% to about 0.2%, from 0% to about 0.1%, from 0% to about 0.05%, or 0%.

Non-Ionic Surfactant

In some embodiments, nonionic detergent surfactant(s) are present in the detergent composition of the present disclosure. These detergent surfactants may also be derived from bio-based sources. The nonionic detergent surfactant may be present in the detergent composition at a concentration of from about 1% to about 30% by weight in one embodiment, but the nonionic detergent surfactant may be present in the detergent composition at a concentration of about 3% to about 20% or from about 10% to about 15% in alternate embodiments, or from about 2% to about 30%, where weight percentages are based on a total weight of the detergent composition. The nonionic detergent surfactant may alternatively be present in an amount of about 1% to about 15% by weight, from about 2% to about 15%, or from about 3% to about 15%. With respect to one another, the by-weight ratio of anionic surfactant blend to non-ionic surfactant is from about 3:1 to about 1:3, or from about 3:1 to about 1:2, or from about 3:1 to about 1:1, or from about 2:1 to about 1:2, or from about 2:1 to about 1:1.

Suitable nonionic detergent surfactants include alkyl glycosides and ethoxylation and/or propoxylation products of alkyl glycosides or linear or branched alcohols in each case having 12 to 18 C atoms in the alkyl moiety and 3 to 20, or 4 to 10, alkyl ether groups. Corresponding ethoxylation and/or propoxylation products of N-alkylamines, vicinal diols, fatty acid esters and fatty acid amides, which correspond to the alkyl moiety in the stated long-chain alcohol derivatives, may furthermore be used. Alkylphenols having 5 to 12 C atoms may also be used in the alkyl moiety of the above described long-chain alcohol derivatives.

Examples of nonionic surfactants suitable for the present invention include, but are not limited to, polyalkoxylated alkanolamides, polyoxyalkylene alkyl ethers, polyoxyalkylene alkylphenyl ethers, polyoxyalkylene sorbitan fatty acid esters, polyoxyalkylene sorbitol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, alkylamine oxides, amine oxide surfactants, alkoxylated fatty alcohols, or a mixture thereof. In some embodiments, the nonionic surfactant is alcohol ethoxylate (AE), alcohol propoxylate, or a mixture thereof. In other embodiments, the nonionic surfactant is AE.

The AE may be primary and secondary alcohol ethoxylates, especially the $C_8$-$C_{20}$ aliphatic alcohols ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles, or from 3 to 8 moles of ethylene oxide per mole of alcohol.

Exemplary AEs are the condensation products of aliphatic $C_8$-$C_{20}$, preferably $C_8$-$C_{16}$, primary or secondary, linear or branched chain alcohols with ethylene oxide. In some embodiments, the alcohol ethoxylates contain 1 to 20, or 3 to 8 ethylene oxide groups, and may optionally be end-capped by a hydroxylated alkyl group.

In one embodiment, the AE has Formula (XIV):

$$R_2—(—O—C_2H_4)_m—OH \quad \text{(XIV)}$$

wherein $R_2$ is a hydrocarbyl group having 8 to 16 carbon atoms, 8 to 14 carbon atoms, 8 to 12 carbon atoms, or 8 to 10 carbon atoms; and m is from 1 to 20, or 3 to 8.

The hydrocarbyl group may be linear or branched, and saturated or unsaturated. In some embodiments, $R_2$ is a linear or branched $C_8$-$C_{16}$ alkyl or a linear group or branched $C_8$-$C_{16}$ alkenyl group. Preferably, $R_2$ is a linear or branched $C_8$-$C_{16}$ alkyl, $C_8$-$C_{14}$ alkyl, or $C_8$-$C_{10}$ alkyl group. In case (e.g., commercially available materials) where materials contain a range of carbon chain lengths, these carbon numbers represent an average. The alcohol may be derived from natural or synthetic feedstock. In one embodiment, the alcohol feedstock is coconut, containing predominantly $C_{12}$-$C_{14}$ alcohol, and oxo $C_{12}$-$C_{15}$ alcohols.

Additional Components

Several other components may optionally be added to and included in the detergent composition, including but not limited to enzymes, peroxy compounds, bleach activators, anti-redeposition agents, neutralizers, optical brighteners, foam inhibitors, chelators, buttering agents, dye transfer inhibitors, soil release agents, water softeners, and other components. A partial, non-exclusive list of additional components (not illustrated) that may be added to and included in the detergent composition include electrolytes, pH regulators, graying inhibitors, anti-crease components, bleach agents, colorants, scents, processing aids, antimicrobial agents, and preservatives.

Possible enzymes that may be in the detergent composition contemplated herein include one or more of a protease, lipase, cutinase, amylase, carbohydrase, cellulase, pectinase, mannanase, arabinase, galactanase, xylanase, and/or peroxidase, but others are also possible. In general, the properties of the selected enzyme(s) should be compatible with the selected detergent composition, (i.e., pH-optimum, compatibility with other enzymatic and non-enzymatic ingredients, etc.). The detergent enzyme(s) may be included in the detergent composition by adding separate additives containing one or more enzymes, or by adding a combined additive comprising all the enzymes that are added to the detergent composition. The enzyme(s) should be present in the detergent composition in effective amounts, such as from about 0 weight percent to about 5 weight percent of enzyme, or from about 0.001 to about 1 weight percent, or from about 0.2 to about 2 weight percent, or from about 0.5 to about 1 weight percent, based on the total weight of the detergent composition, in various embodiments.

One or more anti-redeposition agents may also be optionally included in the detergent composition. Anti-redeposition agents include polymers with a soil detachment capacity, which are also known as "soil repellents" due to their ability to provide a soil-repelling finish on the treated surface, such as a fiber. Anti-redeposition agents include polymers with a soil detachment capacity. One example in regard to polyesters includes copolyesters prepared from dicarboxylic acids, such as adipic acid, phthalic acid or terephthalic acid. In an exemplary embodiment, an anti-redeposition agents includes polyesters with a soil detachment capacity that include those compounds which, in formal terms, are obtainable by esterifying two monomer moieties, the first monomer being a dicarboxylic acid HOOC-Ph-COOH and the second monomer a diol HO—($CHR^{11}$-)aOH, which may also be present as a polymeric diol H—(O—($CHR^{11}$—)$_a$)$_b$OH. Ph here means an ortho-, meta- or para-phenylene residue that may bear 1 to 4 substituents selected from alkyl residues with 1 to 22 C atoms, sulfonic acid groups, carboxyl groups and mixtures thereof. RH means hydrogen or an alkyl residue with 1 to 22 C atoms and mixtures thereof "a" means a number from 2 to 6 and "b" means a number from 1 to 300. The polyesters obtainable therefrom may contain not only monomer diol units —O—($CHR^{11}$—)$_a$O— but also polymer diol units —(O—($CHR^{11}$—)$_a$)$_b$O—. The molar ratio of monomer diol units to polymer diol units may amount to from about 100:1 to about 1:100, or from about 10:1 to about 1:10 in another embodiment. In the polymer diol units, the degree of polymerization "b" may be in the range of from about 4 to about 200, or from about 12 to about 140 in an alternate embodiment. The average molecular weight of the polyesters with a soil detachment capacity may be in the range of from about 250 to about 100,000, or from about 500 to about 50,000 in an alternate embodiment. The acid on which the residue Ph is based may be selected from terephthalic acid, isophthalic acid, phthalic acid, trimellitic acid, mellitic acid, the isomers of sulfophthalic acid, sulfoisophthalic acid and sulfoterephthalic acid and mixtures thereof. Where the acid groups thereof are not part of the ester bond in the polymer, they may be present in salt form, such as an alkali metal or ammonium salt. Exemplary embodiments include sodium and potassium salts.

If desired, instead of the monomer HOOC-Ph-COOH, the polyester with a soil detachment capacity (the anti-redeposition agent) may include small proportions, such as no more than about 10 mole percent relative to the proportion of Ph with the above-stated meaning, of other acids that include at least two carboxyl groups. These include, for example, alkylene and alkenylene dicarboxylic acids such as malonic acid, succinic acid, fumaric acid, maleic acid, glutaric acid, adipic acid, pimelic acid, suberic acid, azelaic acid and sebacic acid. Exemplary diols HO—($CHR^{11}$—)$_a$OH include those in which $R^{11}$ is hydrogen and "a" is a number of from about 2 to about 6, and in another embodiment includes those in which "a" has the value of 2 and $R^{11}$ is selected from hydrogen and alkyl residues with 1 to 10 C atoms, or where $R^{11}$ is selected from hydrogen and alkyl residues with 1 to 3 C atoms in another embodiment. Examples of diol components are ethylene glycol, 1,2-propylene glycol, 1,3-propylene glycol, 1,4-butanediol, 1,5-pentanediol, 1,6-hexanediol, 1,8-octanediol, 1,2-decanediol, 1,2-dodecanediol and neopentyl glycol. The polymeric diols include polyethylene glycol with an average molar mass in the range from about 1000 to about 6000. If desired, these polyesters may also be end group-terminated, with end groups that may be alkyl groups with 1 to 22 C atoms or esters of monocarboxylic acids. The end groups attached via ester bonds may be based on alkyl, alkenyl and aryl monocarboxylic acids with 5 to 32 C atoms, or with 5 to 18 C atoms in another embodiment. These include valeric acid, caproic acid, enanthic acid, caprylic acid, pelargonic acid, capric acid, undecanoic acid, undecenoic acid, lauric acid, lauroleic acid, tridecanoic acid, myristic acid, myristoleic acid, pentadecanoic acid, palmitic acid, stearic acid, petroselinic acid, petroselaidic acid, oleic acid, linoleic acid, linolaidic acid, linolenic acid, eleostearic acid, arachidic acid, gadoleic acid, arachidonic acid, behenic acid, erucic acid, brassidic acid, clupanodonic acid, lignoceric acid, cerotic acid, melissic acid, benzoic acid, which may bear 1 to 5 substituents having a total of up to 25 C atoms, or 1 to 12 C atoms in another embodiment, for example tert-butylbenzoic acid. The end groups may also be based on hydroxymonocarboxylic acids with 5 to 22 C atoms, which for example include hydroxyvaleric acid, hydroxycaproic acid, ricinoleic acid, the hydrogenation product thereof, hydroxystearic acid, and ortho-, meta- and para-hydroxybenzoic acid. The hydroxymonocarboxylic acids may in turn be joined to one another via their hydroxyl group and their carboxyl group and thus be repeatedly present in an end group. The number of hydroxymonocarboxylic acid units per end group, i.e. their degree of oligomerization, may be in the range of from 1 to 50, or in the range of from 1 to 10 in another embodiment. In an exemplary embodiment, polymers of ethylene terephthalate and polyethylene oxide terephthalate, in which the polyethylene glycol units have molar weights of from about 750 to about 5000 and the molar ratio of ethylene terephthalate to polyethylene oxide terephthalate of from about 50:50 to about 90:10, are used alone or in combination with cellulose derivatives. Other suitable anti-redeposition agents are typically polycarboxylate materials. Polycarboxylate materials, which can be prepared by polymerizing or copolymerizing suitable unsaturated monomers, are admixed in their acid form. Unsaturated monomeric acids that can be polymerized to form suitable polycarboxylates include acrylic acid, maleic acid (or maleic anhydride), fumaric acid, itaconic acid, aconitic acid, mesaconic acid, citraconic acid and methylenemalonic acid. The presence in the polycarboxylates herein of monomeric segments, containing no carboxylate radicals such as vinylmethyl ether, styrene, ethylene, etc. is suitable provided that such segments do not constitute more than about 40 wt % of the polymer. Particularly suitable polycarboxylates can be derived from acrylic acid. Such acrylic acid-based polymers which are useful herein are the salts of polymerised acrylic acid. The average molecular weight of such polymers in the acid form ranges from about 2,000 to 10,000, from about 4,000 to 7,000, or from about 4,000 to 5,000. Water-soluble salts of such acrylic acid polymers can include, for example, the alkali metal, ammonium and substituted ammonium salts. Soluble polymers of this type are known materials (e.g., those described in U.S. Pat. No. 3,308,067). In one embodiment, the polycarboxylate is sodium polyacrylate. Acrylic/maleic-based copolymers may also be used as a component of the anti-redeposition agent. Such materials include the salts of copolymers of acrylic acid and maleic acid. The average molecular weight of such copolymers in the acid form ranges from about 2,000 to 100,000, from about 5,000 to 75,000, or from about 7,000 to 65,000. The ratio of acrylate to maleate segments in such copolymers will generally range from about 30:1 to about 1:1, or from about 10:1 to 2:1. Water-soluble salts of such acrylic acid/maleic acid copolymers can include, for example, the alkali metal, ammonium and substituted ammonium salts. Soluble acrylate/maleate copolymers are known materials (e.g., those described in EP 193360). Other useful polymers include maleic/acrylic/vinyl alcohol terpolymers (e.g., a terpolymer containing 45/43/10 of acrylic/maleic/vinyl alcohol as described in EP 193360). The anti-redeposition agent is present in the detergent composition at an amount of from about 0 to about 3 weight percent, or an amount of from about 0 to about 2 weight percent, or an amount of from about 0 to about 1 weight percent, based on the total weight of the detergent composition, in various embodiments.

Neutralizers are optionally added to and included in the detergent composition. Exemplary neutralizers include, but are not limited to, sodium hydroxide, triethanol amine, monoethanol amine, buffers, or other compounds that adjusts the pH of the detergent composition. Neutralizers may be present in the detergent composition at an amount of from about 0 to about 5 weight percent in some embodiments, based on the total weight of the detergent composition, but in other embodiments the neutralizer may be present in the detergent composition at an amount of from about 0 to about 3 weight percent, or an amount of from about 0 to about 2 weight percent, based on the total weight of the detergent composition. The pH of the product detergent composition may be from about 7.0 to about 11.5, such as from about 7.5 to about 11.0.

Optical brighteners may optionally be included in the detergent composition. Optical brighteners adsorb ultraviolet and/or violet light and re-transmit it as visible light, typically a visible blue light. Optical brighteners include, but are not limited to, derivatives of diaminostilbene disulfonic acid or the alkali metal salts thereof. Suitable compounds are, for example, salts of 4,4'-bis(2-anilino-4-morpholino-1,3,5-triazinyl-6-amino)stilbene 2,2'-disulfonic acid or compounds of similar structure which, instead of the morpholino group, bear a diethanolamino group, a methylamino group, an anilino group or a 2-methoxyethylamino group. Optical brighteners of the substituted diphenylstyryl type may furthermore be present, such as the alkali metal salts of 4,4'-bis(2-sulfostyryl)diphenyl, 4,4'-bis(4-chloro-3-sulfostyryl)diphenyl, or 4-(4-chlorostyryl)-4'-(2-sulfostyryl)diphenyl. Mixtures of the above-stated optical brighteners may also be used. Optical brighteners may be present in the detergent composition at an amount of from about 0 to about 1 weight percent in some embodiments, but in other embodiments optical brighteners are present in an amount of from about 0.01 to about 0.5 weight percent, or an amount of from about 0.05 to about 0.3 weight percent, or an amount of from 0.005 to about 5 weight percent, based on the total weight of the detergent composition.

Foam inhibitors may also optionally be included in the detergent composition. Suitable foam inhibitors include, but are not limited to, soaps of natural or synthetic origin, which include an elevated proportion of $C_{18}$-$C_{24}$ fatty acids. Suitable non-surfactant foam inhibitors are, for example, organopolysiloxanes and mixtures thereof with microfine, optionally silanized silica as well as paraffins, waxes, microcrystalline waxes and mixtures thereof with silanized silica or bis-fatty acid alkylenediamides. Mixtures of different foam inhibitors may also be used, for example mixtures of silicones, paraffins or waxes. In an exemplary embodiment, mixtures of paraffins and bistearylethylenediamide may be used. The detergent composition may include the foam inhibitor at an amount of from about 0 to about 5 weight percent, but in other embodiments the foam inhibitor may be present at an amount of from about 0.05 to about 3 weight percent, or an amount of from about 0.5 to about 2 weight percent, based on the total weight of the detergent composition.

Chelators bind and remove calcium, magnesium, or other metals from water, and may optionally be included in the detergent composition. Many compounds can be used as water softeners, including but not limited to ethylenediaminetetraacetic acid (EDTA), nitrilotriacetic acid, diethylenetriaminepenta(methylenephosphonic acid), nitrilotris (methylenephosphonic acid), 1-hydroxyethane-1,1-diphosphonic acid, iminodisuccinic acid (IDS), or other chelating agents. Chelators may be present in the detergent composition at an amount of from about 0 to about 5 weight percent in an exemplary embodiment, but in alternate embodiments the chelators are present at an amount of from about 0.01 to about 3 weight percent or an amount of from about 0.02 to about 1 weight percent, based on the total weight of the detergent composition.

For unit dose pack embodiments, bittering agents may optionally be added to hinder accidental ingestion of the unit dose pack or the detergent composition. Bittering agents are compositions that taste bad, so children or others are discouraged from accidental ingestion. Exemplary bittering agents include denatonium benzoate, aloin, and others. Bittering agents may be present in the detergent composition at an amount of from about 0 to about 1 weight percent, or an amount of from about 0 to about 0.5 weight percent, or an amount of from about 0 to about 0.1 weight percent in various embodiments, based on the total weight of the detergent composition.

In one embodiment, the detergent composition is a laundry detergent composition suitable for use in the washing of fabrics and/or garments. The fabrics and/or garments subjected to a washing, cleaning or textile care processes contemplated herein may be conventional washable laundry, such as household laundry. In some embodiments, the major part of the laundry is garments and fabrics, including but not limited to knits, woven fabrics, denims, non-woven fabrics, felts, yarns, and toweling. The fabrics may be cellulose based such as natural cellulosics, including cotton, flax, linen, jute, ramie, sisal or coir or manmade cellulosics (e.g., originating from wood pulp) including viscose/rayon, ramie, cellulose acetate fibers (tricell), lyocell or blends thereof. The fabrics may also be non-cellulose based such as natural polyamides including wool, camel, cashmere, mohair, rabbit, and silk, or the fabric may be a synthetic polymer such as nylon, aramid, polyester, acrylic, polypropylene and spandex/elastin, or blends of any of the above-mentioned products. Examples of blends are blends of cotton and/or rayon/viscose with one or more companion material such as wool, synthetic fibers (e.g., polyamide fibers, acrylic fibers, polyester fibers, polyvinyl alcohol fibers, polyvinyl chloride fibers, polyurethane fibers, polyurea fibers, aramid fibers), and cellulose-containing fibers (e.g., rayon/viscose, ramie, flax, linen, jute, cellulose acetate fibers, lyocell).

In one embodiment, the fabrics and/or garments are added to a washing machine, and the laundry detergent is also added to the washing machine before wash water is added. The fabrics and/or garments are laundered with the wash water and the laundry detergent. The fabrics and/or garments may then be dried and processed as normal.

ILLUSTRATIVE EXAMPLES

The present disclosure is now illustrated by the following non-limiting examples. It should be noted that various changes and modifications can be applied to the following examples and processes without departing from the scope of this disclosure, which is defined in the appended claims. Therefore, it should be noted that the following examples should be interpreted as illustrative only and not limiting in any sense.

Three different laundry detergent compositions were prepared according to the foregoing description, each having differing amounts of bio-based carbon AES, SLS, and nonionic surfactant, within the ranges and ratios described above ("Examples" 1-3, TABLE 1). All formula examples contain a bio-based carbon content of at least 50%. Additionally, three different benchmark laundry detergent compositions were prepared so as to exclude one or both the AES and SLS ("Benchmarks" A-C, TABLE 1). TABLE 1, below, sets forth the composition of these three exemplary detergent compositions and three benchmark detergent compositions, in terms of weight-percent with the balance being water (it should be noted that unit dose pack embodiments would have the balance being water and one or more hydroxylic solvents such as glycerin, propylene glycol, and polyethylene glycol, for example):

TABLE 1

| | Example 1 | Example 2 | Example 3 | Benchmark A | Benchmark B | Benchmark C |
|---|---|---|---|---|---|---|
| Non-Ionic (C24 EO6-7) | 4 | 4 | 4 | 10.5 | 4 | 4 |
| AES (C24 EO2-3) | 3 | 4.5 | 1.5 | — | 6.5 | — |
| SLS | 3.5 | 2 | 5 | — | — | 6.5 |
| C12-18 Fatty Acid | 0.5 | 0.5 | 0.5 | 0.5 | 0.5 | 0.5 |
| Citric Acid | 3.5 to 4.75 | 3.5 to 4.75 | 3.5 to 4.75 | 3.5 to 4.75 | 3.5 to 4.75 | 3.5 to 4.75 |
| Complexing Agent | 0.25 | 0.25 | 0.25 | 0.25 | 0.25 | 0.25 |
| Protease (enzyme) | 0.5 | 0.5 | 0.5 | 0.5 | 0.5 | 0.5 |
| Amylase (enzyme) | 0.15 | 0.15 | 0.15 | 0.15 | 0.15 | 0.15 |
| Mannannase (enzyme) | 0.15 | 0.15 | 0.15 | 0.15 | 0.15 | 0.15 |
| CaCl2 | 0.05 | 0.05 | 0.05 | 0.05 | 0.05 | 0.05 |
| Preservative | 0.029 | 0.029 | 0.029 | 0.029 | 0.029 | 0.029 |

Each of the three Examples and three Benchmarks were then tested for their viscosities. TABLE 2 summarizes the viscosities in centipoise (using a Brookfield DVII+ Pro Viscometer, LV2 spindle, at a speed of 20 rpm and at a temperature of 20° C.) observed with differing levels of citric acid included in the formulation (either 3.5%, 4%, or 4.75%):

TABLE 2

| | Example 1 | Example 2 | Example 3 | Benchmark A | Benchmark B | Benchmark C |
|---|---|---|---|---|---|---|
| 3.5% Citric Acid | 407 | 322 | 420 | 244 | 165 | 361 |
| 4% Citric Acid | 672 | 557 | 667 | 241 | 322 | 541 |
| 4.75% Citric Acid | 972 | 844 | 938 | 248 | 554 | 743 |

As shown in TABLE 2, the Examples all had significantly better (higher) viscosity that the Benchmarks, at the respective citric acid level. Accordingly, using AES and SLS in combination at the ratios disclosed herein results in an unexpected synergy in terms of increased viscosity, which had been problematic in prior art bio-based carbon detergent compositions without the existence of linear alkylbenzene sulfonate. As previously noted, the increased viscosity has benefits with regard to consumer perception and manufacturing ease (container filling).

Additionally, Example 1 was tested against Benchmarks B and C to determine cleaning performance, wherein TABLE 3 compares Example 1 versus Benchmark B at 90° F. washing conditions, TABLE 4 compares Example 1 versus Benchmark B at 59° F. washing conditions, TABLE 5 compares Example 1 versus Benchmark C at 90° F. washing conditions, and TABLE 6 compares Example 1 versus Benchmark C at 59° F. washing conditions. The tests were conducted using various of eleven stains (blood, chocolate ice-cream, coffee, dust sebum, grape juice, grass, BBQ sauce, mud, butter, make-up, and beef drippings) in 120 ppm hardness water on up to three different fabrics (knitted cotton (KC), woven blend (WB), and polyester (Poly)). Residual Stain Indexes (RSI) were collected following the procedure per the ASTM International standard, designated as D4265 (2014) "Standard Guide for Evaluating Stain Removal Performance in Home Laundering". The RSI values are listed in TABLES 3-6, with Example 1 showing the absolute RSI value, and the Benchmarks showing deviations from Example 1.

TABLE 3

| | | 90° F. | |
|---|---|---|---|
| Stain | Fabric | Example 1 RSI | Benchmark B vs. Example 1 Deviation |
| Blood | KC | 80.19 | 0.21 |
| | WB | 93.50 | 0.28 |
| | Poly | 98.12 | 0.09 |
| Chocolate Ice cream | KC | 95.53 | −0.20 |
| | WB | 97.83 | 0.03 |
| | Poly | 98.67 | 0.02 |
| Coffee | KC | 84.50 | 0.20 |
| | WB | 94.34 | 0.21 |
| | Poly | 95.94 | 0.14 |
| Dust Sebum | KC | 80.89 | 0.09 |
| | WB | 88.04 | 0.34 |
| | Poly | 84.64 | 0.41 |
| Grape Juice | KC | 86.42 | −0.58 |
| | WB | 94.28 | 0.31 |
| | Poly | 92.41 | 0.41 |
| Grass | KC | 74.72 | −0.02 |
| | WB | 83.78 | 0.04 |
| | Poly | 89.78 | −0.25 |
| BBQ Sauce | KC | 93.75 | 1.44 |
| | WB | 96.97 | 0.29 |
| | Poly | 94.34 | −0.17 |
| Mud | KC | 81.57 | 0.24 |
| | WB | 95.07 | 0.12 |
| | Poly | 90.08 | −0.12 |
| Butter | KC | 75.27 | −0.11 |
| | WB | 83.67 | −0.40 |
| | Poly | 87.71 | −0.14 |
| Make-Up | KC | 68.06 | −0.62 |
| | WB | 70.05 | 0.67 |
| | Poly | 86.31 | 0.31 |

TABLE 4

| Stain | Fabric | 59° F. Example 1 RSI | 59° F. Benchmark B vs. Example 1 Deviation |
|---|---|---|---|
| Blood | KC | 78.37 | 0.89 |
| | WB | 92.38 | 0.43 |
| | Poly | 98.31 | 0.01 |
| Chocolate Ice Cream | KC | 92.33 | 0.09 |
| | WB | 97.33 | −0.04 |
| | Poly | 98.71 | 0.04 |
| Coffee | KC | 82.03 | 0.33 |
| | WB | 93.72 | 0.00 |
| | Poly | 95.64 | 0.20 |
| Dust Sebum | KC | 77.64 | 0.09 |
| | WB | 88.19 | −0.02 |
| | Poly | 86.98 | 0.22 |
| Grape Juice | KC | 83.24 | 0.26 |
| | WB | 93.31 | −0.17 |
| | Poly | 92.87 | 0.26 |
| Grass | KC | 71.84 | −0.16 |
| | WB | 82.07 | 0.43 |
| | Poly | 90.23 | 0.33 |
| BBQ Sauce | KC | 0.00 | 0.00 |
| | WB | 96.65 | 0.44 |
| | Poly | 95.25 | −0.66 |
| Mud | KC | 80.20 | 0.05 |
| | WB | 94.81 | 0.12 |
| | Poly | 90.13 | 0.33 |
| Butter | KC | 72.82 | 0.14 |
| | WB | 83.72 | −0.09 |
| | Poly | 89.15 | 0.04 |
| Make-Up | KC | 63.15 | 1.15 |
| | WB | 62.57 | 0.15 |
| | Poly | 81.41 | −1.21 |

TABLE 5

| Stain | Fabric | 59° F. Example 1 RSI | 59° F. Benchmark C vs. Example 1 Deviation |
|---|---|---|---|
| Blood | KC | 86.64 | −2.20 |
| | WB | 92.63 | −0.55 |
| Chocolate Ice Cream | KC | 90.67 | −0.69 |
| | WB | 94.81 | −0.05 |
| Coffee | KC | 86.15 | 0.09 |
| | WB | 93.91 | −0.34 |
| Dust Sebum | KC | 75.68 | −0.29 |
| | WB | 85.90 | −0.87 |
| Grape Juice | KC | 87.35 | 0.18 |
| | WB | 94.14 | −0.96 |
| Grass | KC | 68.17 | −0.90 |
| | WB | 75.07 | −0.42 |
| BBQ Sauce | KC | 94.67 | −0.06 |
| | WB | 96.06 | −0.26 |
| Mud | KC | 79.04 | −0.02 |
| | WB | 90.36 | −0.56 |
| Beef Drippings | KC | 81.65 | −0.19 |
| | WB | 93.68 | −0.37 |

TABLE 6

| Stain | Fabric | 90° F. Example 1 RSI | 90° F. Benchmark C vs. Example 1 Deviation |
|---|---|---|---|
| Blood | KC | 86.93 | −0.78 |
| | WB | 92.65 | −0.30 |

TABLE 6-continued

| Stain | Fabric | 90° F. Example 1 RSI | 90° F. Benchmark C vs. Example 1 Deviation |
|---|---|---|---|
| Chocolate Ice Cream | KC | 94.77 | −0.51 |
| | WB | 95.93 | −0.19 |
| Coffee | KC | 88.45 | −0.33 |
| | WB | 94.48 | −0.21 |
| Dust Sebum | KC | 78.28 | −1.16 |
| | WB | 86.53 | −0.42 |
| Grape Juice | KC | 90.32 | −0.85 |
| | WB | 94.11 | −0.03 |
| Grass | KC | 70.06 | −0.24 |
| | WB | 77.23 | −0.97 |
| BBQ Sauce | KC | 96.24 | −0.28 |
| | WB | 96.46 | −0.13 |
| Mud | KC | 79.75 | −0.32 |
| | WB | 90.86 | −0.12 |
| Beef Drippings | KC | 85.62 | 0.19 |
| | WB | 95.91 | −0.29 |

As can be seen in TABLES 3-6, the Example 1 detergent performed as-well (particularly against Benchmark B) or better (particularly against Benchmark C) under most tests as compared with either Benchmark B or Benchmark C. Accordingly, using AES and SLS in combination at the ratios disclosed herein results in an unexpected synergy in terms of increased cleaning ability, which had been problematic in prior art organic-based carbon detergent compositions.

Accordingly, the present disclosure has shown that it is possible to remove anionic surfactants from detergent compositions that have high synthetic carbon content, such as linear alkylbenzene sulfonate (LAS) and synthetic alkyl ethoxylate sulfate (AES), and replace them with particular surfactants that have high bio-based carbon content, while overcoming prior art challenges of poor cleaning capability and unacceptably-low viscosity. In particular, it has been shown that using an anionic surfactant blend of bio-based AES in combination with sodium lauryl sulfate (SLS) in particular weight-percent ratios, namely from about 5:1 to about 1:5, the aforementioned problems of poor cleaning capability and unacceptably-low viscosity can be overcome.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the subject matter in any way. Rather, the foregoing detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A detergent composition comprising:

an anionic detergent surfactant blend comprising alkyl ethoxylate sulfate (AES) and sodium lauryl sulfate (SLS), wherein a weight ratio of AES to SLS is from about 4:1 to about 1:4 and wherein the anionic detergent surfactant blend is present in an amount of about 2% to about 10% by weight of the detergent composition; and a nonionic detergent surfactant comprising an alcohol ethoxylate (AE), wherein a weight ratio of the anionic detergent surfactant blend to nonionic detergent surfactant is from about 3:1 to about 1:3 and wherein the nonionic detergent surfactant blend is present in an amount of about 3% to about 15% by weight of the detergent composition;

water, and citric acid;

wherein a bio-based carbon content of the detergent composition is from about 50% to about 100% by weight of the overall detergent composition; and wherein the detergent composition has a viscosity of at least about 300 centipoise.

2. The detergent composition of claim 1, wherein the detergent composition is formulated as a liquid detergent composition.

3. The detergent composition of claim 1, wherein the detergent composition is formulated as a unit dose pack detergent composition.

4. The detergent composition of claim 1, wherein the ratio of the AES to SLS is from about 3:1 to about 1:3.

5. The detergent composition of claim 4, wherein the ratio of the AES to SLS is from about 2:1 to about 1:2.

6. The detergent composition of claim 1, wherein the bio-based carbon content of the detergent composition is from about 60% to about 100%.

7. The detergent composition of claim 6, wherein the bio-based carbon content of the detergent composition is from about 90% to about 100%.

8. The detergent composition of claim 1, further comprising an additive comprising one or more of: enzymes, peroxy compounds, bleach activators, anti-redeposition agents, neutralizers, optical brighteners, foam inhibitors, chelators, bittering agents, dye transfer inhibitors, soil release agents, water softeners, electrolytes, pH regulators, graying inhibitors, anti-crease components, colorants, scents, processing aids, antimicrobial agents, and preservatives.

9. The detergent composition of claim 1 substantially excluding linear alkylbenzene sulfonate (LAS).

10. The detergent composition of claim 1, wherein the citric acid is present in an amount of about 3% to about 5% by weight of the detergent composition.

11. A detergent composition comprising:

an anionic detergent surfactant blend comprising alkyl ethoxylate sulfate (AES) and sodium lauryl sulfate (SLS), wherein a weight ratio of AES to SLS is from about 4:1 to about 1:4 and wherein the anionic detergent surfactant blend is present in an amount of about 2% to about 10% by weight of the detergent composition; and a nonionic detergent surfactant comprising an alcohol ethoxylate (AE), wherein a weight ratio of the anionic detergent surfactant blend to nonionic detergent surfactant is from about 3:1 to about 1:3 and wherein the nonionic detergent surfactant blend is present in an amount of about 3% to about 15% by weight of the detergent composition; and citric acid present in an amount of about 3% to about 5% by weight of the detergent composition, wherein a bio-based carbon content of the detergent composition is from about 50% to about 100% by weight of the overall detergent composition, and wherein the detergent composition substantially excludes linear alkylbenzene sulfonate (LAS), and wherein the detergent composition has a viscosity of at least about 300 centipoise.

* * * * *